US006655627B2

(12) United States Patent
Patton

(10) Patent No.: US 6,655,627 B2
(45) Date of Patent: Dec. 2, 2003

(54) MODULAR SPOOLER

(76) Inventor: Scott L. Patton, 18505 Auburn Rd., Huntertown, IN (US) 46748

( * ) Notice: Subject to any disclaimer, the term of this patent is extended or adjusted under 35 U.S.C. 154(b) by 0 days.

(21) Appl. No.: 09/850,820

(22) Filed: May 8, 2001

(65) Prior Publication Data

US 2001/0035473 A1 Nov. 1, 2001

Related U.S. Application Data

(60) Provisional application No. 60/202,627, filed on May 9, 2000.

(51) Int. Cl.[7] ..... B65H 27/00

(52) U.S. Cl. ..... 242/397.2; 242/401; 242/407.1; 242/577.4

(58) Field of Search ..... 242/401, 407, 242/407.1, 397.2, 397.4, 577.4, 604.1

(56) References Cited

U.S. PATENT DOCUMENTS

| | | | | |
|---|---|---|---|---|
| 1,108,726 A | * | 8/1914 | Eichhoff | 242/577.4 |
| 1,186,027 A | * | 6/1916 | Olson | 242/577.4 |
| 2,197,180 A | | 4/1940 | Jenne et al. | 242/129 |
| 2,946,535 A | | 7/1960 | K. Marion | 242/84 |
| 3,134,555 A | | 5/1964 | Baker | 242/86.5 |
| 3,556,431 A | | 1/1971 | Freitag | 242/129 |
| 3,575,358 A | | 4/1971 | Manner | 242/105 |
| 3,603,526 A | | 9/1971 | Payne et al. | 242/129.8 |
| 3,902,679 A | | 9/1975 | Bost | 242/129 |
| 4,667,897 A | | 5/1987 | Burrow et al. | 242/129 |
| 4,953,810 A | | 9/1990 | Stadig | 242/129 |

* cited by examiner

*Primary Examiner*—John Q. Nguyen
(74) *Attorney, Agent, or Firm*—Taylor & Aust, P.C.

(57) ABSTRACT

A spooler is used for storing and distributing an elongate, flexible member. The spooler has a base and a rotary support rotatably and detachably mounted to the base. A plurality of load-bearing arms are detachably connected to and extend radially from the rotary support. At least one spool guide is included, each spool guide being slidably located and selectively mounted along one of the load-bearing arms. Each spool guide extends substantially vertically from one of the load-bearing arms.

16 Claims, 6 Drawing Sheets

MODULAR SPOOLER

CROSS REFERENCE TO RELATED APPLICATIONS

This is a non-provisional patent application based upon U.S. provisional patent application Ser. No. 60/202,627, entitled "SPOOL 'N TOOL", filed May 9, 2000.

BACKGROUND OF THE INVENTION

1. Field of the invention

The present invention relates to stock dispensing reels or spools, and, more particularly, to devices for carrying such reels or spools.

2. Description of the Related Art

Elongate, flexible members, such as a flexible gas line, tubing for at least one of plumbing and heating, electric cable, wiring, and communication cable, are commonly stored upon reels or spools. Various devices are now available for carrying such reels or spools and dispensing the stock therefrom. However, such devices can be difficult to transport and set up. Another problem with such devices tends to be an inability to achieve an even feed of material in any desired circumferential location with respect to the spool or reel. A yet further shortfall is that such devices are not designed to accommodate a variety of coil/spool sizes.

What is needed in the art is spool dispensing device which is easily transported and set up; promotes even feed of material in any desired circumferential direction with respect to the device; and readily accommodates a variety of coil sizes.

SUMMARY OF THE INVENTION

The present invention provides a spool assembly which is both readily assembled and disassembled, is able to accommodate various inner coil diameters of coils of an elongate, flexible member and can accommodate a variety of coil sizes.

The invention comprises, in one form thereof, a spooler used for storing and distributing an elongate, flexible member. The spooler has a base and a rotary support rotatably and detachably mounted to the base. A plurality of load-bearing arms are detachably connected to and extend radially from the rotary support. At least one spool guide is included, each spool guide being slidably located and selectively mounted along one of the load-bearing arms. Each spool guide extends substantially vertically from one of the load-bearing arms.

The invention comprises, in another form thereof, a spooler for storing and distributing an elongate, flexible member. The spooler includes a base and a first rotary support rotatably and detachably mounted relative to the base. A plurality of first load-bearing arms is provided, each first load-bearing arm being detachably connected to and extending radially from the first rotary support. A central extension is detachably mounted to and extends substantially vertically upward from the first rotary support. A second rotary support is rotatably and detachably mounted on the central extension. A plurality of second load-bearing arms are provided, each second load-bearing arm being detachably connected to and extending radially from the second rotary support. Each second load-bearing arm corresponds to a first load-bearing arm, each second load-bearing arm and the corresponding first load-bearing arm forming an arm pair. At least one spool guide is provided, each spool guide extending between an arm pair. Each spool guide is slidably located and selectively mounted along each of the second load-bearing arm and the corresponding first load-bearing arm of the arm pair.

An advantage of the present invention is that such a spool assembly is both easily and quickly assembled and disassembled.

Another advantage is that the spool assembly is modular in construction, the constituent parts capable of all fitting in a duffle bag, making transport easy.

Yet another advantage is that multiple spool assemblies can be stacked upon one another, allowing multiple pipes, tubing, cables, wires, etc., to be unspooled simultaneously.

A further advantage is an eyelet or feed-through guide can be used which guides the flow of the elongate, flexible member off of the spool, preventing uncoiling thereof from off the top of the spool (which can be especially helpful in tight locations).

A yet another advantage is that the center handle permits easy transport of the spool assembly around the job site, can be used to adjust resistance for unspooling and acts as a site upon which another spooler can be stacked.

An even another advantage is that the radial position of each of the spool guides can be adjusted to accommodate various inner coil diameters of coils of the elongate, flexible member.

An even further advantage is a three-legged base permits stable positioning even on uneven surfaces.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
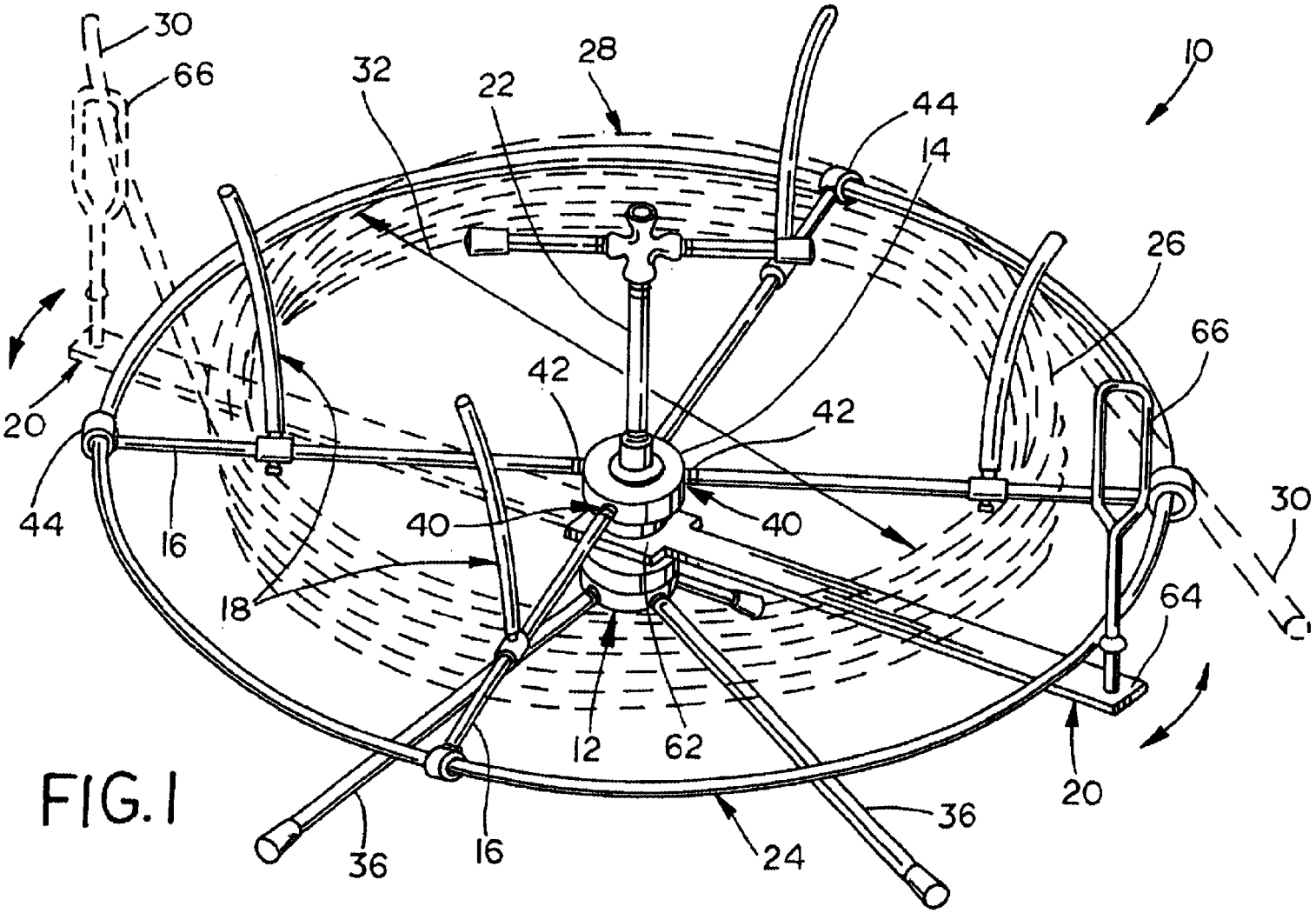
FIG. 1 is a perspective view of a modular spooler of one embodiment of the present invention.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

Referring now to the drawings, and more particularly to FIG. 1, there is shown a spooler 10 which generally includes a base 12, rotary support 14, load-bearing arms 16 and spool guides 18. Spooler 10 further includes a feeder mechanism 20, a handle 22 and an annular support 24.

Figure 2:
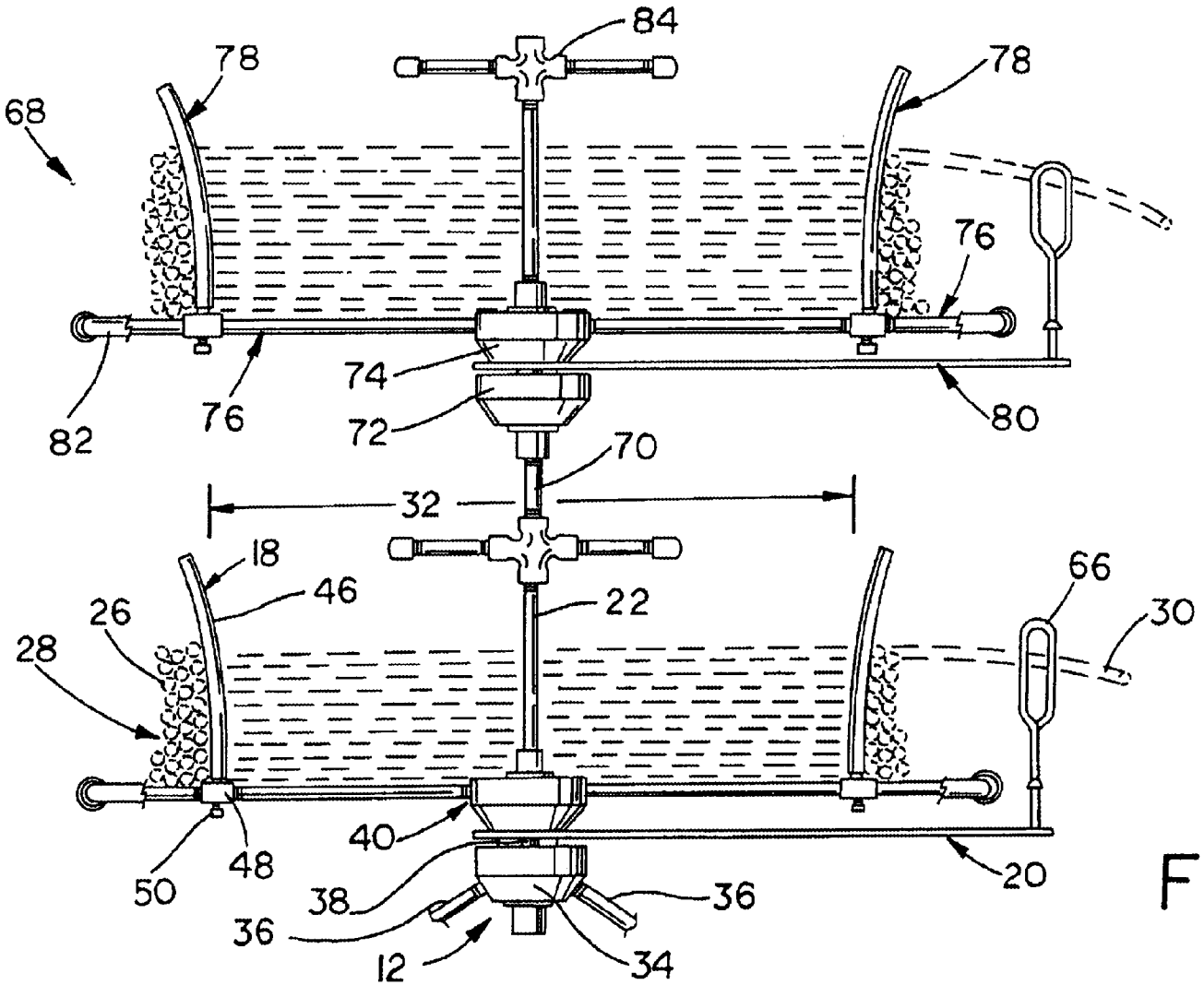
FIG. 2 is a cut-away view of a modular spooler in a stacked configuration of one embodiment of the present invention.

Spooler 10 is used to store and distribute an elongate, flexible member 26, shown in phantom in FIG. 1 and in cross-section in FIG. 2. Elongate, flexible member 26 is stored in the form of a coil 28 on spooler 10. Coil 28 has two free coil ends 30 and an inner coil diameter 32 associated therewith. Elongate, flexible member 26 is, for example, a flexible gas line, tubing for plumbing and/or heating, electric cable, wiring, or communication cable.

Base 12 includes, in the present embodiment, a base hub 34 and three legs 36 detachably connected thereto, as by screw-threading (as shown in this embodiment) or by a simple male-female slide connection (shown in another embodiment). Base hub 34 further has a vertically extending shaft 38 associated therewith.

Rotary support 14 is detachably and rotatably mounted on shaft 38. Rotary support 14 is provided with a plurality of mounting locations 40, each for receiving one load-bearing arm 16. In this embodiment, mounting location 40 is a threaded mount hole.

Each load-bearing arm 16 is releasably attached to a mounting location 40 of rotary support 14. Specifically, each load-bearing arm 16, in this embodiment, has a threaded arm end 42 for connection to mounting location 40. Opposite threaded arm end 42 of each load-bearing arm 16 is a receiver arm end 44.

In the present embodiment, each load-bearing arm 16 has one spool guide 18 radially positioned therealong. The positions of spool guides 18 are collectively chosen so as to match inner coil diameter 32 of coil 28 in order laterally hold coil 28 in place on load-bearing arms 16. At minimum, at least one load-bearing arm 16 has an associated spool guide 18 to help position coil 28. Preferably, at least two such combinations exist with the pair of spool guides 18 being substantially diametrically opposed to one another relative to rotary support 14 in order to help maintain inner coil diameter 32. Most preferably, each load-bearing arm 16 has an associated spool guide 18, thereby offering significant lateral stability for coil 28.

Figure 3:
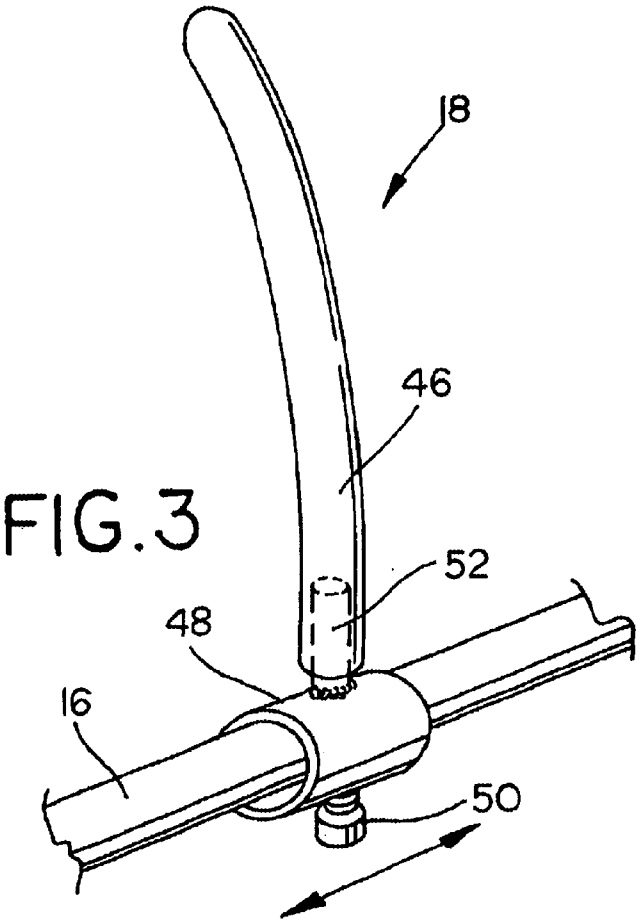
FIG. 3 is a cut-away view of a load-bearing arm of the present embodiment with a spool guide attached thereto.

In this embodiment, each spool guide 18 has a guide member 46 (best seen in FIGS. 2 and 3), a guide holder 48 and a guide bolt 50. Guide member 46 is slidably and removably mounted onto guide post 52 (shown in phantom in FIG. 3) of guide holder 48. Guide bolt 50 is selectively actuatable for stabilizing the position of guide holder 48 relative to respective load-bearing arm 16.

Figure 4:
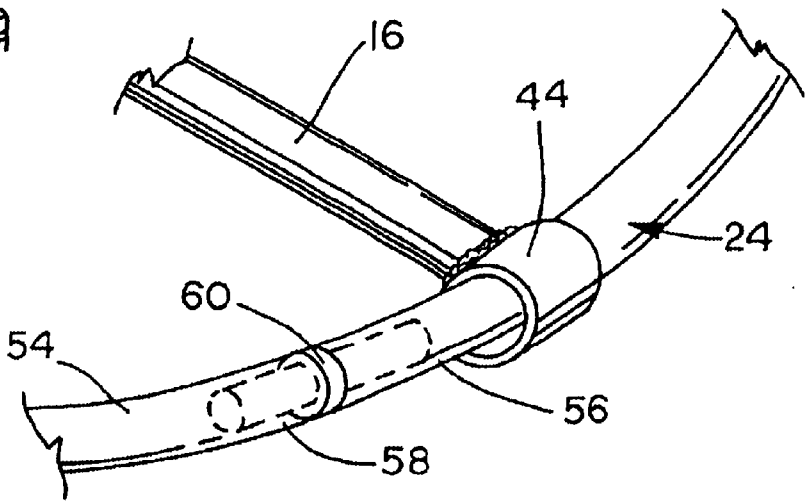
FIG. 4 is a cut-away view including the attachment area between a load-bearing arm and the annular support of the present embodiment.

Annular support 24 is fed through and thereby held by each of receiver arm ends 44 (best seen in FIGS. 1 and 4). Further, annular support 24 is made of a piece of tubing 54 that has a first tubing end 56 and a second tubing end 58. First tubing end 56 and a second tubing end 58 are slidably and releasably connected to one another via tubing end connector 60 (shown part in phantom in FIG. 4). Tubing 54 is made of one of plastic, metal, and a composite thereof, and preferably is made of a composite of aluminum and plastic. Tubing 54, when made of the preferred composite, can be bent into shapes in addition to having good corrosion resistance and mechanical durability. Annular support 24 helps to keep free coil ends 30 from dragging on the ground. Also, annular support 24 helps minimize the potential radial outward movement and lateral movement of each receiver arm end 44, thereby helping to stabilize the positioning of load-bearing arms 16.

Feeder mechanism 20 is freely rotatably and detachably mounted on first feeder end 62 thereof, as seen from FIGS. 1 and 2, making feeder mechanism 20 freely mounted relative to both base 12 and rotary support 14. Feeder mechanism 20 has a second feeder end 64 with second feeder end 64 carrying a feed-through guide 66. Feed-through guide 66 is mounted proximate second feeder end 64 and extends substantially vertically therefrom. Feed-through guide 66, as shown in FIG. 1 in a phantom view of repositioned feeder mechanism 20 and also in FIG. 2, is configured for receiving free coil end 30 (shown in phantom in FIGS. 1 and 2) therethrough and for thereby aiding in the guiding and positioning of elongate, flexible member 26.

Handle 22 is detachably mounted upon rotary support 14, such as by screw-threading, as shown. Handle 22 is used in transporting spooler 10 around a job site and to help control the resistance for unspooling. The resistance can be adjusted by turning handle 22 clockwise or counterclockwise, as desired.

A second spooler 68 can be mounted atop spooler 10 via handle 22. Specifically, a spool connector 70 is detachably connected (e.g., by screw threading) to both handle 22 and second base hub 72. Second base hub 72 can be made to be interchangeable with base hub 34 by being configured for having legs attached thereto or may not be configured as such. In any event, beyond the issue of leg attachment, base hub 34 and second base hub 72 are structured and function in a similar manner.

Second spooler 68 also includes a second rotary support 74, a plurality of second load-bearing arms 76, a plurality of second spool guides 78, second feeder mechanism 80, second annular support 82 and second handle 84. Other than a possible difference in base hub 34 and second base hub 72, spooler 10 and second spooler 68 are structured and function in a similar manner, with like parts used in each being interchangeable therebetween. It is contemplated that further spoolers could also be attached upon second spooler 68.

Figure 5:
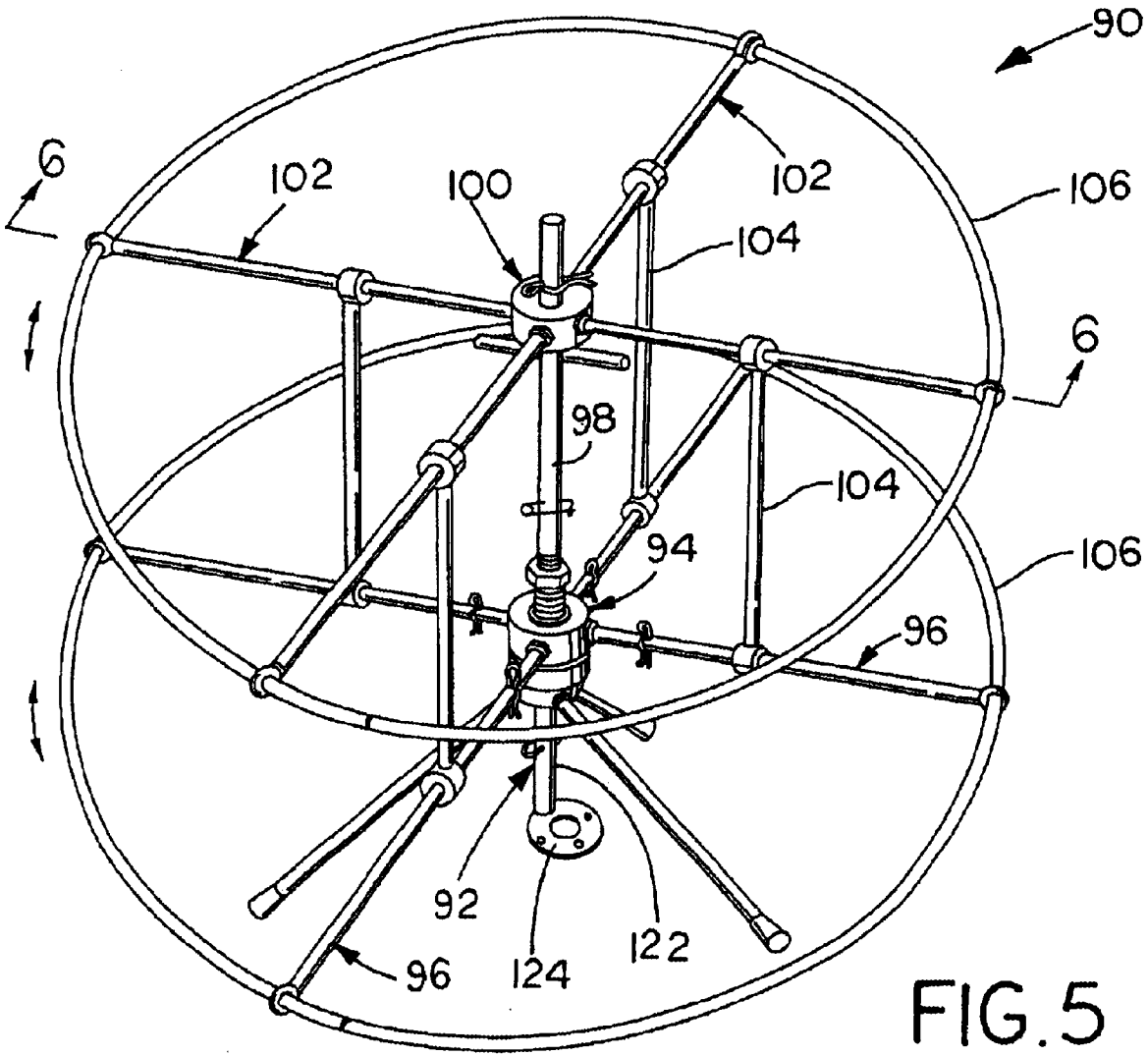
FIG. 5 is a perspective view of an alternate embodiment of a spooler of the present invention.
Figure 6:
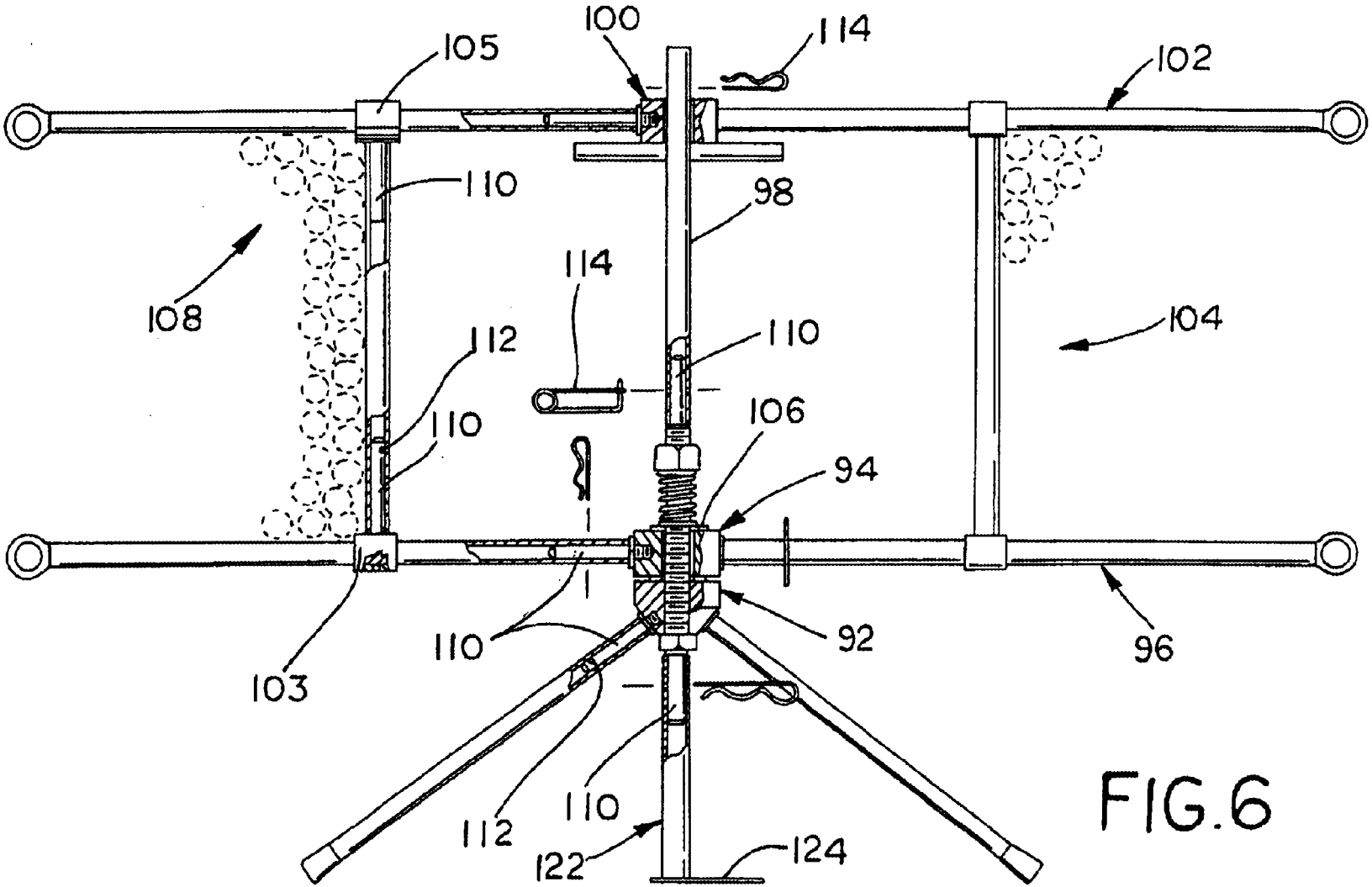
FIG. 6 is a sectional view taken along the line 6—6 of the spooler shown in FIG. 5.
Figure 7:
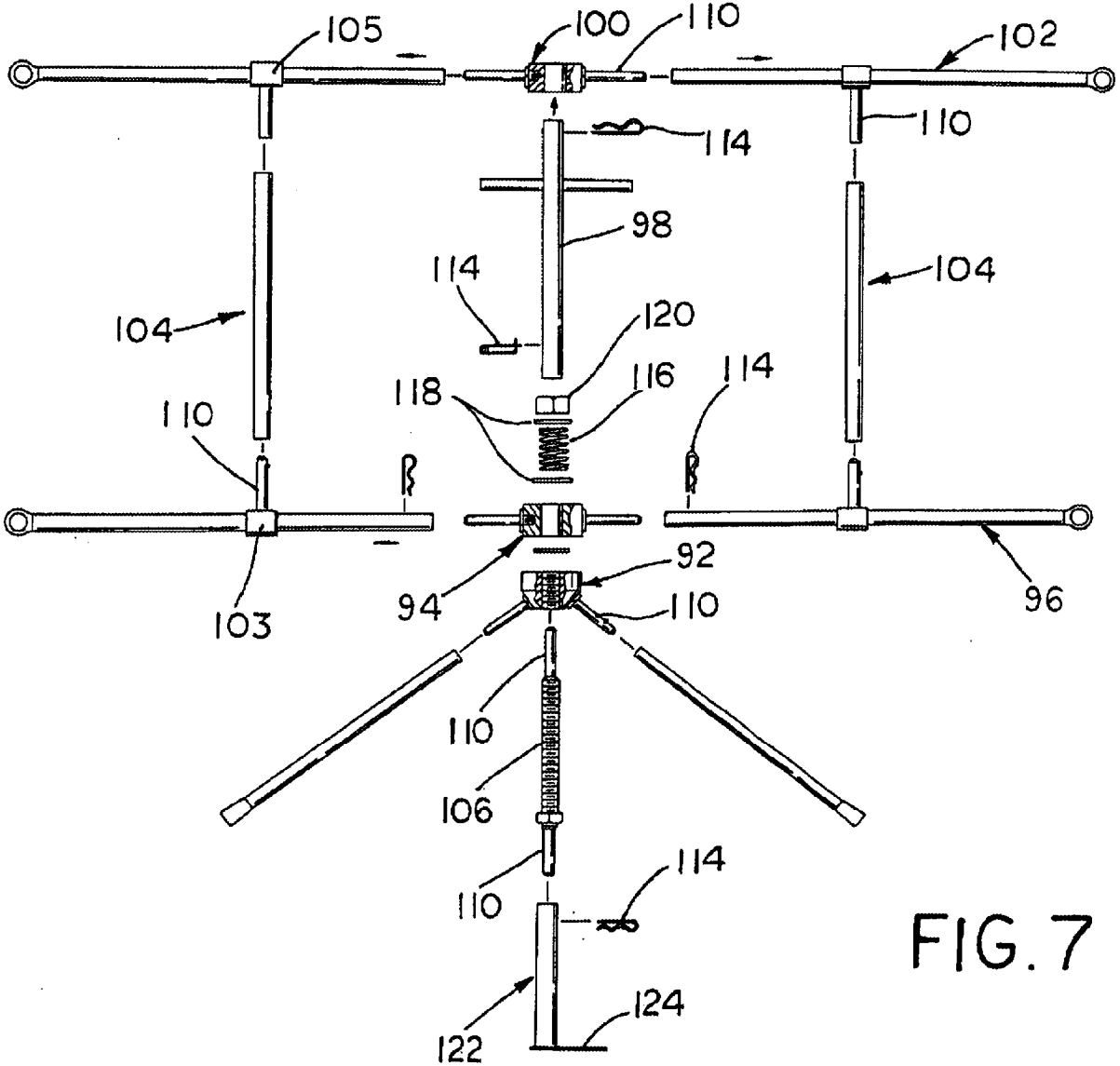
FIG. 7 is an exploded view of the spooler shown in FIG. 6.

In an alternate embodiment shown in FIGS. 5–7, spooler 90 includes a base 92, a first rotary support 94, a plurality of first load-bearing arms 96, a central extension 98, a second rotary support 100, a plurality of second load-bearing arms 102 and a plurality of annular supports 106. Except for the differences set forth in the discussion of this embodiment, spooler 90 and the parts thereof are otherwise structurally and functionally similar to spooler 10 and second spooler 68.

A primary structural difference of this alternate embodiment is the provision of second rotary support 100 and second load-bearing arms 102 and the connection thereof to the remainder of spooler 90. Specifically, second rotary support is slidably mounted upon central extension 98, which also acts as a handle. Central extension 98, in turn, is slidably mounted upon shaft 106 (best seen in exploded view FIG. 7), shaft 10 extending through first rotary support 94 and into base 92. Additionally, spool guides 104 each are rigid and have a first guide end 103 and a second guide end 105. First guide end 103 and a second guide end 105 are selectively radially mounted along a corresponding first load-bearing arm 96 and second load-bearing arm 102, respectively. Due to such construction, spooler 90 is able to hold coil 108 in position extremely well, while still being easily assembled and disassembled.

Another structural difference associated with the alternate embodiment is the reliance upon male connector extensions 110 (a portion of which are labeled) to ease the slide connection of parts, some of which are provided with a friction button 112 to help aid the retention thereof In other locations, a connector pin 114 may be used in addition to or instead of friction button 112 to retain a particular male connector extension 110 within a given male/female connection.

A further feature of the alternate embodiment is the provision of a tension spring 116, with corresponding washers 118 and tightening nut 120, on shaft 106. By turning of central extension 98 using the handle feature thereof, tightening nut 120 is either tightened upon or loosened away from tension spring 116. Consequently, tension spring 116 can be used to preload first rotary support 94 against base 92, thereby reducing unwanted feed-out from coil 108 after stopping of pulling thereon.

A yet additional feature of the alternate embodiment is that one base leg 122, at least, has a connector plate 124 attached thereto (e.g., metallurgically and/or mechanically). Connector plate 124 is configured for receiving a stake, nail, screw or other fastener therethrough in order to better hold base 92 to the floor or ground (neither shown).

Upon providing of spooler 10, coil 28 of elongate, flexible member 26 is placed around each spool guide 18 on spooler 10. Coil 28 is supported on load-bearing arms 16, and coil inner diameter 32 is supported by each spool guide 18. Free coil end 30 is pulled upon to thereby feed out a length of elongate, flexible member 26.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A spooler for storing and distributing an elongate, flexible member, said spooler comprising:

a base including a plurality of legs threadably mounted to said base;

a rotary support rotatably and detachably mounted to said base;

a plurality of load-bearing arms, each load-bearing arm including a threaded arm end, each load-bearing arm being both threadably connected to and extending radially from said rotary support at said threaded arm end; and at least one spool guide, each spool guide being slidably located and selectively mounted along one of said load-bearing arms, each spool guide extending substantially vertically from one of said load-bearing arms.

2. The spooler of claim 1, further comprising a feeder mechanism having a feed-through guide, said feeder mechanism having a first feeder end freely rotatably mounted with respect to said base and said rotary support, said feeder mechanism having a second feeder end carrying said feed-through guide.

3. The spooler of claim 2, wherein said feed-through guide is mounted proximate said second feeder end and extends substantially vertically therefrom.

4. The spooler of claim 2, wherein said feed-through guide is configured for receiving and guiding the elongate, flexible member therethrough.

5. The spooler of claim 1, further comprising a handle connected to and extending vertically from said rotary support.

6. The spooler of claim 5, wherein said handle is configured for facilitating the carrying of said spooler.

7. The spooler of claim 5, wherein said handle has a second spooler mounted thereto opposite said rotary support, said second spooler comprising:

a second rotary support rotatably and detachably mounted relative to said handle;

a plurality of second load-bearing arms, each second load-bearing arm being detachably connected to and extending radially from said second rotary support; and at least one second spool guide, each second spool guide being selectively mounted along and extending substantially vertically from one of said second load-bearing arms.

8. The spooler of claim 7, wherein a further base hub is connected to said handle opposite said rotary support, said further base hub supporting said second spooler upon said handle.

9. The spooler of claim 1, wherein each said load-bearing arm has both an arm longitudinal axis and a receiver arm end opposite said threaded arm end, said receiver arm end including a hollow receiver having a receiver longitudinal axis approximately perpendicular to said arm longitudinal axis, said receiver arm ends conjunctively carrying an annular support in said hollow receivers, said annular support being disconnectable.

10. The spooler of claim 9, wherein said annular support is comprised of tubing made of one of plastic, metal, and a composite thereof.

11. The spooler of claim 1, wherein said spooler includes at least a first spool guide and a second spool guide, said first spool guide and said second spool guide conjunctively configured for holding the elongate, flexible member laterally in place on said spooler.

12. The spooler of claim 1, wherein said base includes at least three legs for supporting said spooler.

13. The spooler of claim 12, wherein at least one leg has a connector plate attached thereto, said connector plate being configured for receiving at least one connector therethrough.

14. A method of feeding an elongate, flexible member from a spooler, said method comprising the steps of:

providing a spooler, said spooler comprising:

a base including a plurality of legs threadably mounted to said base;

a rotary support rotatably and detachably mounted to said base;

a plurality of load-bearing arms, each load-bearing arm including a threaded arm end, each load-bearing arm being both threadably connected to and extending radially from said rotary support at said threaded arm end; and at least one spool guide, each spool guide being slidably located and selectively mounted along one of said load-bearing arms, each spool guide extending substantially vertically from one of said load-bearing arms;

providing a coil of the elongate, flexible member around said at least one spool guide on said spooler, said coil having a free coil end and an inner coil diameter, said coil being supported on said load-bearing arms, said inner coil diameter being supported by said at least one spool guide; and pulling on said free coil end to thereby feed out a length of the elongate, flexible member.

15. The method of claim 14, further comprising the steps of:

providing a feeder mechanism having a feed-through guide, said feeder mechanism having a first feeder end freely rotatably mounted with respect to said base and said rotary support, said feeder mechanism having a second feeder end carrying said feed-through guide;

inserting said free coil end through said feed-through guide; and controlling a feed-out of said elongate, flexible member using said feed-through guide.

16. The method of claim 14, wherein said elongate, flexible member is one of a flexible gas line, tubing for at least one of plumbing and heating, electric cable, wiring, and communication cable.

* * * * *